US009136579B2

(12) United States Patent
Lee et al.

(10) Patent No.: US 9,136,579 B2
(45) Date of Patent: Sep. 15, 2015

(54) PHASE SHIFTER USING SUBSTRATE INTEGRATED WAVEGUIDE

(75) Inventors: Hai-Young Lee, Seongnam-si (KR); Ki-Bum Kang, Suwon-si (KR); Jin do Byun, Anyang-si (KR)

(73) Assignee: AJOU UNIVERSITY INDUSTRY COOPERATION FOUNDATION, Suwon-Si (KR)

( * ) Notice: Subject to any disclaimer, the term of this patent is extended or adjusted under 35 U.S.C. 154(b) by 422 days.

(21) Appl. No.: 13/511,942

(22) PCT Filed: Nov. 4, 2010

(86) PCT No.: PCT/KR2010/007746

§ 371 (c)(1),
(2), (4) Date: May 24, 2012

(87) PCT Pub. No.: WO2011/065681

PCT Pub. Date: Jun. 3, 2011

(65) Prior Publication Data

US 2012/0274419 A1 Nov. 1, 2012

(30) Foreign Application Priority Data

Nov. 27, 2009 (KR) ..... 10-2009-0115488

(51) Int. Cl.
*H01P 5/18* (2006.01)
*H01P 5/10* (2006.01)
(Continued)

(52) U.S. Cl.
CPC *H01P 5/18* (2013.01); *H01P 1/182* (2013.01); *H01P 5/10* (2013.01); *H01P 1/184* (2013.01); *H01P 5/107* (2013.01); *H01P 5/12* (2013.01)

(58) Field of Classification Search
CPC ..... H01P 1/18; H01P 3/08; H01P 5/18; H01P 5/12; H01P 1/182; H01P 1/184; H01P 5/10; H01P 5/107
USPC ..... 333/26, 113, 137, 157, 208, 25, 239
See application file for complete search history.

(56) References Cited

U.S. PATENT DOCUMENTS

2004/0251992 A1* 12/2004 Kim et al. ..... 333/208
2007/0052503 A1 3/2007 Van Quach et al. ..... 333/238
2009/0303145 A1* 12/2009 Shijo et al. ..... 343/767

FOREIGN PATENT DOCUMENTS

CN 200962450 * 10/2007
CN 101325273 A 12/2008
(Continued)

OTHER PUBLICATIONS

Boudreau, "Broadband Phase Shifter Using Air Holes in Substrate Integrated Waveguide", Jun. 2011, IEEE, pp. 1-4.*
Sellal, "Design of a Substrate Integrated Waveguide Phase Shifter", May 2006, Information and Communication Technologies, 2006. ICTTA '06. 2nd vol. 2155-2160.*
(Continued)

*Primary Examiner* — Benny Lee
*Assistant Examiner* — Jorge Salazar, Jr.
(74) *Attorney, Agent, or Firm* — Stein IP, LLC

(57) ABSTRACT

Provided is a phase shifter using a substrate integrated waveguide (SIW). The phase shifter includes: a substrate; and a waveguide integrated on the substrate, wherein the waveguide includes an input port, an out port, two columns of via walls which are separated by a width of the waveguide and are arranged parallel to each other, and either a plurality of air holes which are formed to shift a phase of a signal between the input port and the output port or a plurality of rods, each including an air hole and a dielectric material inserted into the air hole.

13 Claims, 10 Drawing Sheets

(51) Int. Cl.

| | |
|---|---|
| ***H01P 1/18*** | (2006.01) |
| *H01P 5/107* | (2006.01) |
| *H01P 5/12* | (2006.01) |

(56) References Cited

FOREIGN PATENT DOCUMENTS

| | | | | |
|---|---|---|---|---|
| EP | 1 376 746 | A1 | | 1/2004 |
| EP | 1376746 | A1 | * | 1/2004 |
| JP | 2005-318360 | A | | 11/2005 |
| KR | 10-0626647 | B1 | | 10/2003 |

OTHER PUBLICATIONS

Korean Office Action issued Apr. 5, 2011, to the corresponding Korean Application No. 10-2009-0115488.

Korean Notice of Allowance issued Oct. 28, 2011, to the corresponding Korean Application No. 10-2009-0115488.

Chinese Office Action issued Dec. 24, 2013, to the corresponding Chinese Application No. 201080053821.1.

Chinese Office Action issued Sep. 2, 2014, to the corresponding Chinese Application No. 201080053821.1.

International Search Report filed in PCT/KR2010/007746 Date:Jun. 29, 2011.

* cited by examiner

PHASE SHIFTER USING SUBSTRATE INTEGRATED WAVEGUIDE

CROSS-REFERENCE TO RELATED APPLICATIONS

This application claims the benefit of PCT International Patent Application No. PCT/KR2010/007746, filed Nov. 4, 2010, and Korean Patent Application No. 10-2009-0115488, filed Nov. 27, 2009, in the Korean Intellectual Property Office, the disclosures of which are incorporated herein by reference.

BACKGROUND OF THE INVENTION

1. Field of the Invention

The present invention relates to a phase shifter using a substrate integrated waveguide (SIW), and more particularly, to a phase shifter implemented through the formation of air holes and dielectric insertion in an SIW.

2. Description of the Related Art

A phase shifter is a device that changes or adjusts the phase of an electrical signal. It is widely used in microwave system applications such as wireless communication, radar, and measurement equipment. Phase shifters can be implemented in various ways. In particular, phase shifters using a substrate integrated waveguide (SIW) have recently been developed.

An SIW includes columns of via walls, which are arranged parallel to each other, on a dielectric substrate. Thus, it has a similar function to a conventional waveguide. In addition, the SIW has the advantages of both the conventional waveguide and a microstrip transmission line, like high Q factor, high power capacity, smaller size, and the possibility of integration. These advantages enable the SIW to be widely used in microwave and millimeter-wave circuits such as resonators, filters, and antennas. Phase shifter recently developed using this SIW are implemented by inserting ferrite toroid into the SIW or inserting a metal pole into the middle of the SIW.

Phase shifters must be designed to meet various performance requirements in terms of insertion loss, bandwidth, power capacity, size, weight, phase error, and the like. However, phase shifters using ferrite toroid are difficult to manufacture and are large in size and weight. On the other hand, phase shifters having a metal pole inserted into the middle of an SIW can easily adjust an amount of phase change by changing the position of the metal pole. However, since insertion loss increases as the amount of phase change increases, there is a limit to the amount of phase change.

SUMMARY OF THE INVENTION

The following description relates to a phase shifter which can be simply manufactured by forming air holes in a substrate of a substrate integrated waveguide (SIW) and inserting a dielectric material whose dielectric constant is different from that of the substrate into each of the air holes and which can be designed to provide a required amount of phase shift by adjusting a size of the air holes, a gap between the air holes, and the number of the air holes.

The following description also relates to a balun which can be simply manufactured by forming air holes in a substrate of an SIW and inserting a dielectric material whose dielectric constant is different from that of the substrate into each of the air holes and which can be designed to make conversion between an unbalanced signal and a balanced signal in the SIW by adjusting a size of the air holes, a gap between the air holes, and the number of the air holes.

The following description also relates to a directional coupler which can be simply manufactured by forming air holes in a substrate of an SIW and inserting a dielectric material whose dielectric constant is different from that of the substrate into each of the air holes.

The following description also relates an SIW which can vary a phase of a signal.

In one general aspect, there is provided a phase shifter using a substrate integrated waveguide (SIW). The phase shifter includes: a substrate; and a waveguide integrated on the substrate, wherein the waveguide includes an input port, an out port, two columns of via walls which are separated by a width of the waveguide and are arranged parallel to each other, and either a plurality of air holes which are formed to shift a phase of a signal between the input port and the output port or a plurality of rods, each including an air hole and a dielectric material inserted into the air hole.

When the waveguide includes the air holes, an amount by which the phase of the signal is shifted between the input port and the output port may vary according to at least one of a diameter of the air holes, a distance between the air holes, and the number of the air holes. When the waveguide includes the rods, the amount by which the phase of the signal is shifted between the input port and the output port may vary according to at least one of a diameter of the rods, a distance between the rods, and the number of the rods.

The amount by which the phase of the signal is shifted may increase in proportion to an increase in the diameter of the air holes.

The amount by which the phase of the signal is shifted may increase in proportion to an increase in at least one of the diameter of the rods and the number of the rods.

Each of the rods may have a structure in which the dielectric material is inserted into the air hole by using a male-female screwing method.

The amount by which the phase of the signal is shifted between the input port and the output port may increase in proportion to an increase in a depth to which the dielectric material is inserted into the air hole in each of the rods.

In another aspect, there is provided a balun using an SIW. The balun includes: a substrate; and a waveguide integrated on the substrate, wherein the waveguide includes two columns of via walls which are separated by a width of the waveguide and are arranged parallel to each other, an input port, a power divider which divides power of a signal input to the input port, first and second branches of the power divider, and a first output port and a second output port which are connected respectively to the first branch and the second branch, wherein any one of the first and second branches has a plurality of rods, each including an air hole and a dielectric material inserted into the air hole, and the other one of the first and second branches has a plurality of air holes or no air holes.

In another aspect, there is provided a directional coupler using an SIW. The directional coupler includes: a substrate; and a waveguide integrated on the substrate, wherein the waveguide includes a first input branch, a second input branch, a first output branch, a second output branch, a first column of via walls which is located between the first input branch and the second input branch, a second column of via walls which is located between the first output branch and the second output branch, an input port which is connected to one of the first input branch and the second input branch, and an isolated port which is connected to the other one of the first input branch and the second input branch, a power divider which divides power of a signal input to the input port between the first output branch and the second output branch, and a first output port and a second output port which are connected respectively to the first output branch and the second output branch, wherein any one of the first and second output branches has a plurality of rods, each including an air hole and a dielectric material inserted into the air hole, and the other one of the first and second branches has no air holes.

In another aspect, there is provided an SIW including: a substrate; and a waveguide integrated on the substrate, wherein the waveguide includes two columns of via walls which are separated by a width of the waveguide and are arranged parallel to each other and a plurality of rods, each including an air hole and a dielectric material inserted into the air hole by using a male-female screwing method to variably shift a phase of a signal.

Other features and aspects will be apparent from the following detailed description, the drawings, and the claims.

A phase shifter which can be simply manufactured by forming air holes in a substrate of a substrate integrated waveguide (SIW) and inserting a dielectric material whose dielectric constant is different from that of the substrate into each of the air holes and which can be designed to provide a required amount of phase shift by adjusting a size of the air holes, a gap between the air holes, and the number of the air holes can be implemented.

In addition, a balun which can be simply manufactured by forming air holes in a substrate of an SIW and inserting a dielectric material whose dielectric constant is different from that of the substrate into each of the air holes and which can be designed to make conversion between an unbalanced signal and a balanced signal in the SIW by adjusting a size of the air holes, a gap between the air holes, and the number of the air holes can be implemented.

Further, a directional coupler can be simply implemented by forming air holes in a substrate of an SIW and inserting a dielectric material whose dielectric constant is different from that of the substrate into each of the air holes.

Further, a plurality of dielectric rods formed in an SIW can variably shift a phase of a signal, wherein each of the dielectric rods includes an air hole and a dielectric material inserted into the air hole using by a male-female screwing method.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which.

Figure 1:
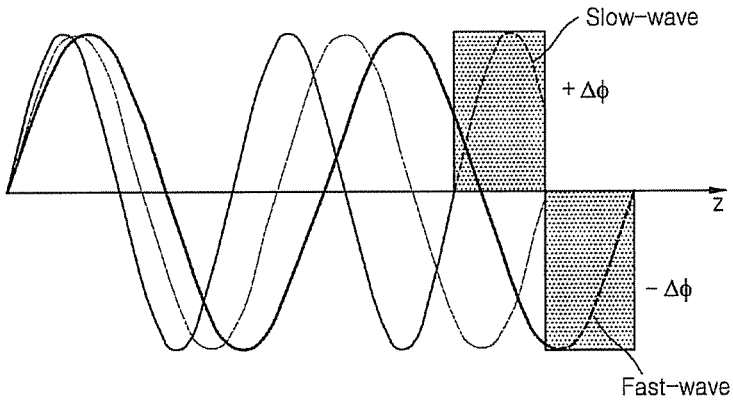
FIG. 1 is a diagram illustrating the principles of a phase shifter using a substrate integrated waveguide (SIW) according to an exemplary embodiment of the present invention.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION OF THE EMBODIMENTS

Reference will now be made in detail to the present embodiments of the present invention, examples of which are illustrated in the accompanying drawings, wherein like reference numerals refer to the like elements throughout. The embodiments are described below in order to explain the present invention by referring to the figures.

FIG. 1 is a diagram illustrating the principles of a phase shifter using a substrate integrated waveguide (SIW) according to an exemplary embodiment of the present invention.

An SIW has a $TEm_0$ mode only. Wavenumber (k) in the $TEm_0$ mode is proportional to the square root of a dielectric constant, and a propagation constant β may be defined by $$k = \omega\sqrt{\mu\varepsilon} \tag{1}$$

$$k_c = \sqrt{\left(\frac{m\pi}{a}\right)^2 + \left(\frac{n\pi}{b}\right)^2}$$

-continued $$\beta = \sqrt{k^2 - k_c^2}$$

$$v_p = \frac{\omega}{\beta}.$$

A guided wavelength $\lambda_g$ is in inversely proportional to the propagation constant β. Thus, when an effective dielectric constant inside the waveguide changes, a phase velocity $v_p$ of a wave also changes, thereby shifting an insertion phase of the waveguide as illustrated in the drawing. A reduction in the phase velocity $v_p$ resulting from an increase in the effective dielectric constant is referred to as a "slow-wave effect," and the opposite is referred to as a "fast-wave effect."

A phase shifter using substrate air holes and dielectric insertion is based on the above two principles (i.e., the fast-wave and slow-wave effects). When air holes are formed in a substrate with a relatively high dielectric constant (k), they are filled with air having a dielectric constant of 1. If the air holes are filled with a relatively low-k material, an effective dielectric constant of the entire substrate is reduced. This increases the phase velocity of a wave, causing a negative (−) phase shift. Conversely, after air holes are formed in a substrate with a relatively low dielectric constant, if the air holes are filled with a high-k material, the slow-wave effect may occur, leading to a positive (+) phase shift.

Figure 2:
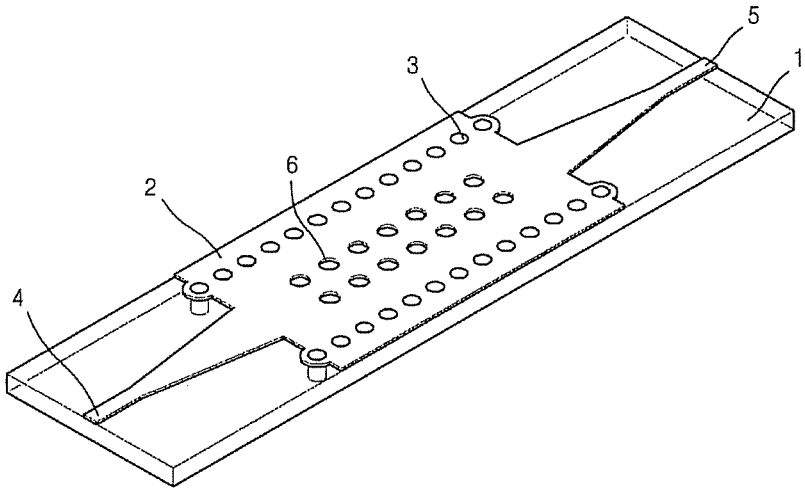
FIG. 2 is a perspective view of a phase shifter using an SIW according to an exemplary embodiment of the present invention.
Figure 3:
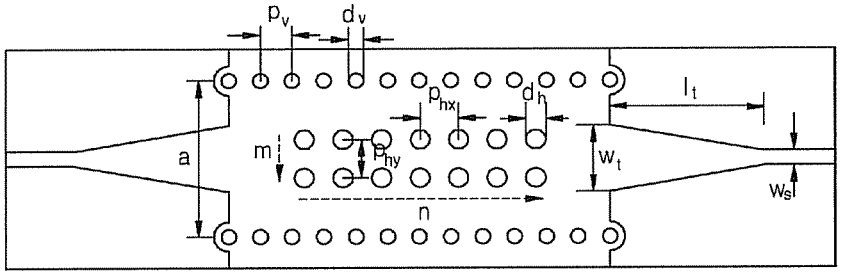
FIG. 3 is a plan view of the phase shifter shown in FIG. 2.

FIG. 2 is a perspective view of a phase shifter using an SIW according to an exemplary embodiment of the present invention. FIG. 3 is a plan view of the phase shifter shown in FIG. 2.

Referring to FIGS. 2 and 3, the phase shifter may include a substrate 1 and a waveguide 2 integrated on the substrate 1. The waveguide 2 may include an input port 4, an output port 5, two columns 3 of via walls which are separated by a width a of the waveguide 2 and are arranged parallel to each other, and a plurality of air holes 6 which penetrate the substrate 1 to shift the phase of a signal between the input and output ports 4 and 5. The phase shifter was designed by taking the width a of the waveguide 2, a diameter $d_v$ of the via walls, a gap $P_v$ between the via walls, etc. into consideration, as described above with reference to FIG. 1. Each of the input and output ports 4 and 5 has a transition structure to a microstrip line for measurement, and the transition structure may be tapered. A length $I_t$ and a width $w_t$ of the transition structure may be designed in a way that minimizes conductor loss and dielectric loss and, at the same time, ensures superior impedance matching to minimize reflection loss.

The amount by which the phase of a signal is shifted between the input and output ports 4 and 5 may vary according to at least one of a diameter $d_h$ of the air holes 6, a gap $p_{hx,y}$ between the air holes 6, and the number (m×n) of the air holes 6. Basically, the amount by which the phase of a signal is shifted increases in proportion to an increase in the diameter $d_h$ of the air holes 6. Further, the amount by which the phase of the signal is shifted is mostly proportional to the number (m×n) of the air holes 6 and can be adjusted by the gap $p_{hx,y}$ between the air holes 6. Ultimately, the amount by which the phase of the signal is shifted can be adjusted using at least one of the diameter $d_h$ of the air holes 6, the gap $p_{hx,y}$ (distance) between the air holes 6, and the number (m×n) of the air holes 6.

Actual implemented examples of the phase shifter according to the current exemplary embodiment will now be described. Phase shifters providing general phase shift values, e.g., 11.25°, 22.5°, and 45°, respectively, at a center frequency of 15 GHz were designed, and their characteristics were identified. A substrate used for each of these phase shifters was Rogers Corporation's Duroid 6010 ($\in_T$=10.2, tan δ=0.0023) with a thickness of 0.635 mm. In addition, values of basic waveguide design variables were a=5 mm, $d_v$=0.5 mm, $p_v$=1 mm, $I_t$=5 mm, $w_t$=2.1 mm, and $w_s$=0.5 mm, and design variables for achieving a required amount of phase shift, such as a the diameter $d_h$ of air holes, the gap $p_{hx,y}$ between the air holes, and the number (m×n) of the air holes, are listed in Table 1 below. For design and interpretation, high frequency structural simulator (HFSS) 10 of Ansoft Corporation was used. HFSS 10 is a commonly used simulation tool that is based on a finite element method (FEM).

TABLE 1

| | $d_h$ [mm] | $p_{hx}$ [mm] | $p_{hy}$ [mm] | m × n |
|---|---|---|---|---|
| 11.25° | 0.55 | 0.85 | — | 1 × 3 |
| 22.5° | 0.55 | 0.85 | 0.85 | 2 × 3 |
| 45° | 0.55 | 0.85 | 0.85 | 2 × 7 |

Figure 4:
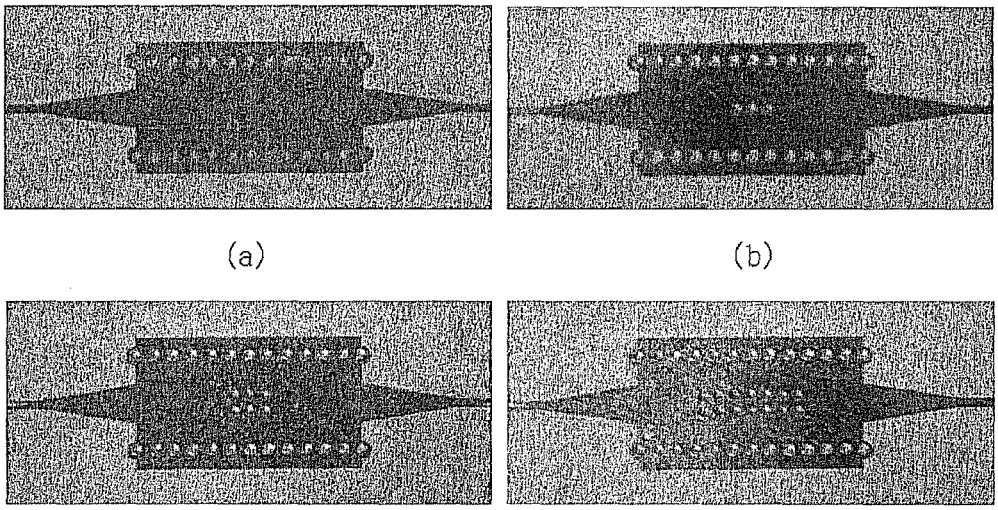
FIG. 4(*a*), FIG. 4(*b*), FIG. 4(*c*) and FIG. 4(*d*) are diagrams illustrating real models of the phase shifter shown in FIGS. 2 and 3.
Figure 5:
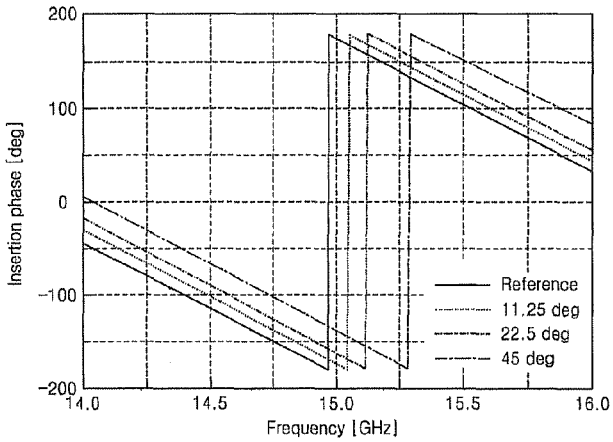
FIG. 5 is a graph illustrating insertion phase measurements according to an exemplary embodiment of the present invention.

Real models of the phase shifters designed using the simulation tool were made and are illustrated in FIG. 4. Specifically, (a) of FIG. 4 shows a reference waveguide, (b) of FIG. 4 shows an 11.25-degree bit phase shifter, (c) of FIG. 4 shows a 22.5-degree bit phase shifter, and (d) of FIG. 4 shows a 45-degree bit phase shifter. Phase shift values of these phase shifters were measured, and the measurement results are illustrated in FIG. 5. Referring to FIG. 5, the phase shift values of the phase shifters are reduced at each frequency as the number of air holes is reduced. This is because of the fast-wave effect. That is, air holes in the substrate reduced the effective dielectric constant of the substrate, thereby increasing the phase velocity of a wave within the waveguide. In addition, the phase shifters exhibit relatively accurate phase shift results. Thus, although the 22.5-degree phase shifter shows the greatest phase error at a design frequency of 15 GHz, its phase error is only 0.64 degrees.

Figure 6:
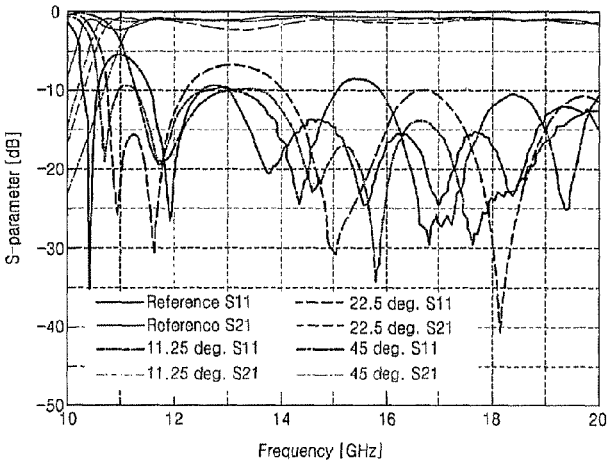
FIG. 6 is a graph illustrating the insertion loss and reflection loss of the model phase shifters manufactured to identify characteristics of the phase shifter of FIG. 4.

FIG. 6 is a graph illustrating the insertion loss and reflection loss of the phase shifters manufactured to identify characteristics of the phase shifter of FIG. 4. The insertion loss of a phase shifter in a conventional SIW increases as the magnitude of phase shift increases. On the other hand, referring to FIG. 6, the insertion losses of the model phase shifters are maintained low over the entire pass band after the cut-off frequency of the waveguide. In particular, the phase shifters have an insertion loss of −0.92 dB at a design frequency of 15 GHz. Measurement results (including phase error) of each phase shifter are shown in Table 2.

TABLE 2

| | S11 [dB] | S21 [dB] | Phase error [°] |
|---|---|---|---|
| Ref. | −14.72 | −0.57 | — |
| 11.25° | −18.11 | −0.48 | −0.08 |
| 22.5° | −29.95 | −0.92 | −0.64 |
| 45° | −10.05 | −0.78 | −0.11 |

A phase shifter using an SIW according to another exemplary embodiment of the present invention may have a rod structure in which a dielectric material is inserted into each of the air holes 6 of the phase shifter according to the embodiment of FIGS. 2 and 3.

That is, the phase shifter using the SIW according to the current exemplary embodiment may include a substrate and a waveguide integrated on the substrate. The waveguide may include an input port, an output port, two columns of via walls which are separated by a width of the waveguide and are arranged parallel to each other, and a plurality of rods, each including an air hole formed in the substrate and a dielectric material inserted into the air hole to shift the phase of a signal between the input and output ports. The amount by which the phase of a signal is shifted between the input and output ports may vary according to at least one of a diameter of the rods, a distance between the rods, and the number of rods. The amount by which the phase of the signal is shifted may increase in proportion to an increase in the diameter of the rods. In addition, the amount by which the phase of the signal is shifted may increase as the number of rods increases.

A dielectric constant of the dielectric material inserted into each air hole may be different from that of the substrate, and each of the input and output ports may have a transition structure to a microstrip line for measurement. The transition structure may be tapered.

To identify characteristics of the phase shifter according to the current exemplary embodiment, phase shifters providing general phase shift values, e.g., 11.25°, 22.5°, and 45°, respectively, at a center frequency of 15 GHz were designed, and their characteristics were identified. A substrate used for each of these phase shifters was Rogers Corporation's Duroid 4003 ($\in_T$=3.38, tan δ=0.0027) with a thickness of 0.813 mm, and a high-k material inserted into each air hole of the substrate was Duroid 6010 ($\in_T$=10.2, tan δ=0.0023). In addition, values of basic waveguide design variables were a=8 mm, $d_v$=0.5 mm, $p_v$=1 mm, $I_t$=8 mm, $w_t$=3 mm, and $w_s$=1.74 mm, and design variables for achieving a required amount of phase shift, such as a diameter $d_r$ of rods, a gap $p_{rx,y}$ between the rods, and the number (m×n) of the rods, are listed in Table 3 below.

TABLE 3

| | $d_r$ [mm] | $p_{rx}$ [mm] | $p_{ry}$ [mm] | m × n |
|---|---|---|---|---|
| 11.25° | 0.75 | 1.3 | — | 1 × 3 |
| 22.5° | 0.75 | 1.3 | 1.15 | 2 × 3 |
| 45° | 0.75 | 1.15 | 1.15 | 2 × 6 |

Figure 7:
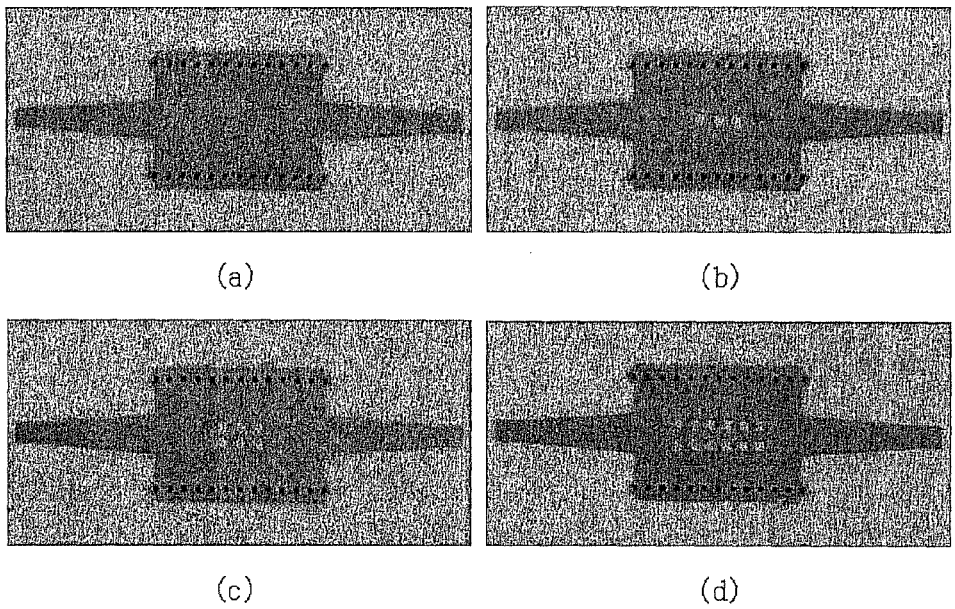
FIG. 7(*a*), FIG. 7(*b*), FIG. 7(*c*) and FIG. 7(*d*) are diagrams illustrating real models of a phase shifter which has a high-k material inserted into each air hole according to another exemplary embodiment of the present invention.

Real models of the phase shifters having the high-k material inserted into each air hole were made and are illustrated in FIG. 7. Specifically, (a) of FIG. 7 shows a reference waveguide, (b) of FIG. 7 shows an 11.25-degree bit phase shifter, (c) of FIG. 7 shows a 22.5-degree bit phase shifter, and (d) of FIG. 7 shows a 45-degree bit phase shifter. Each of the phase shifters shown in (b) through (d) of FIG. 7 has a structure in which a dielectric material is inserted into each air hole.

Figure 8:
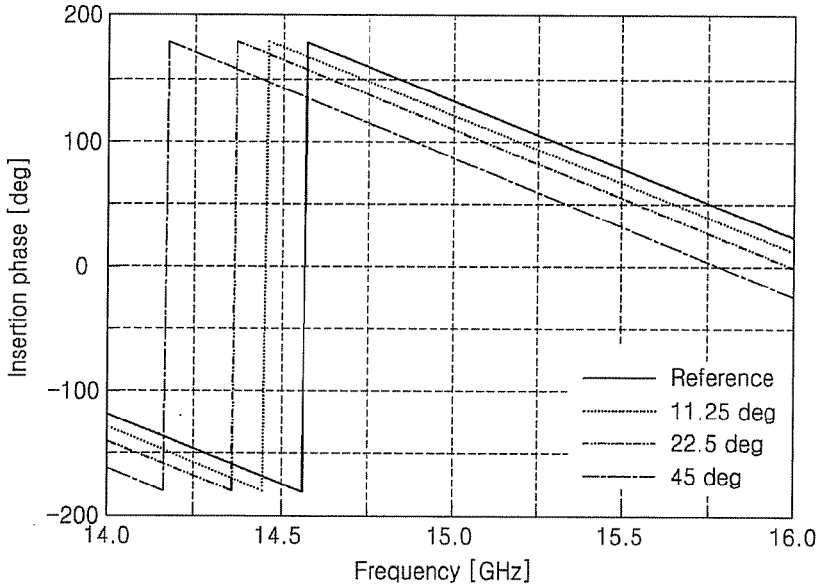
FIG. 8 is a graph illustrating phase shift measurements.

Phase shift values of these phase shifters were measured, and the measurement results are illustrated in FIG. 8. Referring to FIG. 8, the phase shift values of the phase shifters increase at each frequency as the number of high-k rods increases. This is because the phase shifters having the high-k material inserted into each air hole of the substrate have the slow-wave effect, contrary to the above-described phase shifters using only substrate air holes. That is, the high-k material inserted into each air hole reduces the effective dielectric constant of the substrate, thereby reducing the phase velocity of a wave within the waveguide.

Figure 9:
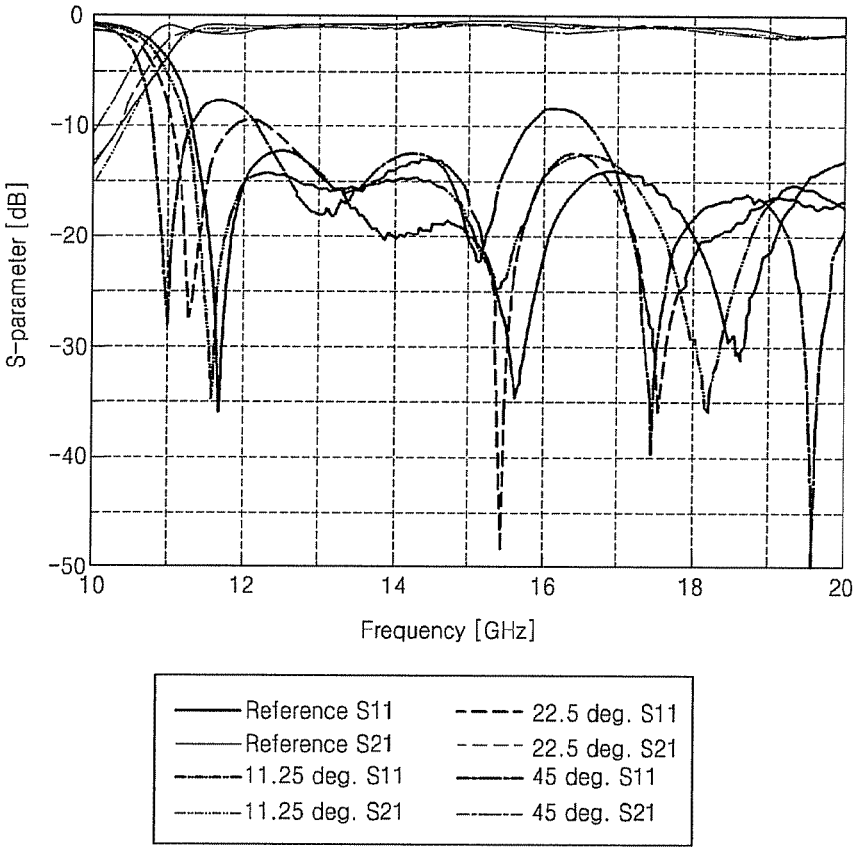
FIG. 9 is a graph illustrating phase error, insertion loss, and reflection loss.

Like the above-described phase shifters using only substrate air holes, the phase shifters using dielectric insertion exhibit superior characteristics in terms of phase error, insertion loss, and reflection loss as illustrated in FIG. 9. Specific values are shown in Table 4.

TABLE 4

| | S11 [dB] | S21 [dB] | Phase error [°] |
|---|---|---|---|
| Ref. | −19.92 | −0.57 | — |
| 11.25° | −18.71 | −0.79 | −0.02 |
| 22.5° | −16.67 | −0.84 | −0.07 |
| 45° | −20.07 | −0.73 | 0.17 |

Figure 10:
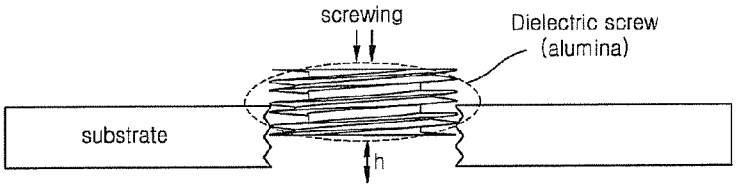
FIG. 10 is a diagram illustrating a male-female screwing method by which a dielectric material is inserted into an air hole.

Meanwhile, a dielectric material may be inserted into each of a plurality of air holes by using a male-female screwing method, an embodiment of which is illustrated in FIG. 10. Referring to FIG. 10, an air hole may be formed in a substrate of an SIW, and a female screw line may be formed on a wall of the air hole. Then, a dielectric screw in the form of a male screw is inserted into the air hole along the female screw line. Since the dielectric material having a different dielectric constant from that of the substrate is inserted into the air hole, the effective dielectric constant and phase constant of a transmission line may change, resulting in a phase shift. A variable phase shift can be achieved according to the degree (depth) to which the dielectric screw is inserted into the air hole. That is, the phase shift may increase in proportion to an increase in the depth to which the dielectric material is inserted into the air hole.

Figure 11:
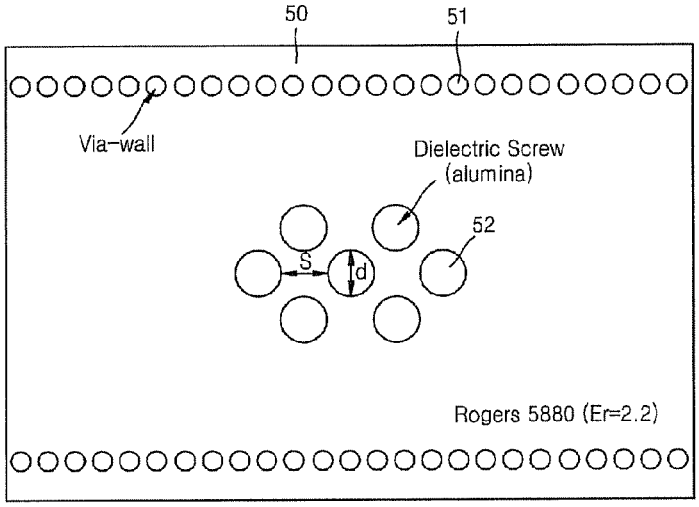
FIG. 11 is a diagram illustrating a phase shifter having rods, each including an air hole and a dielectric material inserted into the air hole by the male-female screwing method.

An SIW for a variable phase shift is illustrated in FIG. 11. Referring to FIG. 11, the SIW includes a waveguide 50 integrated on a substrate (not shown), and the waveguide 50 includes two columns 51 of via walls, which are separated by a width of the waveguide 50 and are arranged parallel to each other, and a plurality of rods 52, each including an air hole and a dielectric material inserted into the air hole by using a male-female screwing method to variably shift the phase of a signal. Since the rods 52 are formed using the male-female screwing method, the phase of a signal can be changed by adjusting a dielectric screw that is inserted into each air hole by using the male-female screwing method. An applied frequency band of the SIW is an X band, a substrate used for interpretation is Rogers 5880 ($\in_T$=2.2), and the dielectric screw is alumina ($\in_T$=9.4). A diameter of the via walls and a gap between the via walls are 0.6 mm, respectively, and a diameter d of each dielectric screw used and a gap s between the dielectric screws is 2 mm, respectively.

Figure 12:
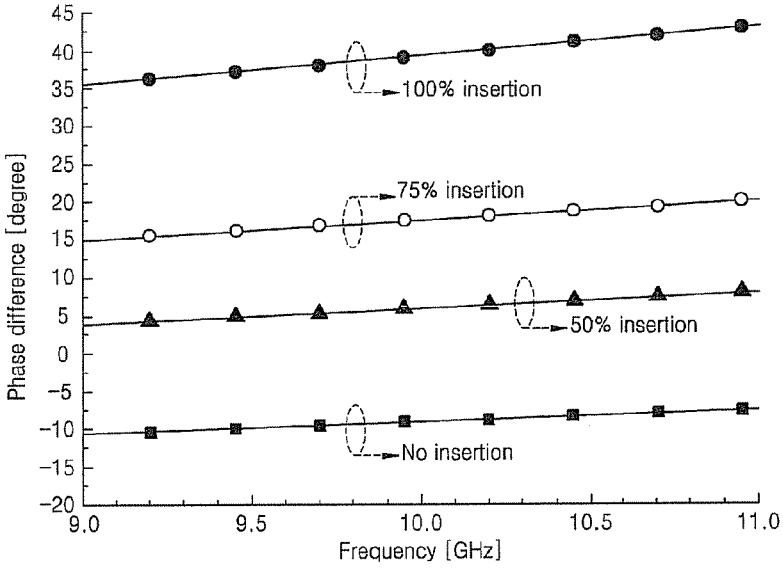
FIG. 12 is a graph illustrating the amount of phase shift at each frequency with respect to the insertion rate of dielectric screws in an SIW shown in FIG. 11.

FIG. 12 is a graph illustrating the amount of phase shift at each frequency with respect to the insertion rate of dielectric screws in the SIW shown in FIG. 11. Referring to FIG. 12, a phase shifter using the SIW of FIG. 11 provides a greater amount of phase shift as the insertion rate (depth) to which the dielectric screws are inserted into the air holes of the substrate increases. In addition, the phase shifter using the SIW of FIG. 11 provides a greater amount of phase shift than a phase shifter of an SIW without air holes and dielectric screws. When only air holes are formed in a substrate but when dielectric screws are not inserted into the air holes, the effective dielectric constant of the substrate is reduced, resulting in a reduced amount of phase shift. When a screw-type dielectric material is inserted into each air hole of the substrate as in the SIW of FIG. 11, the amount of phase shift can be variably adjusted according to the depth to which the dielectric material is inserted. This variable SIW using dielectric screws can be used not only for variable and fixed phase shifters but also for phase correction of a large power distribution network of a phased array system.

A phase shifter using an SIW according to yet another exemplary embodiment of the present invention may be configured to perform a balun function. Here, the term "balun" is an abbreviation of "balance-unbalance." It is a circuit or structure that converts a balanced signal into an unbalanced signal and vice versa.

Figure 13:
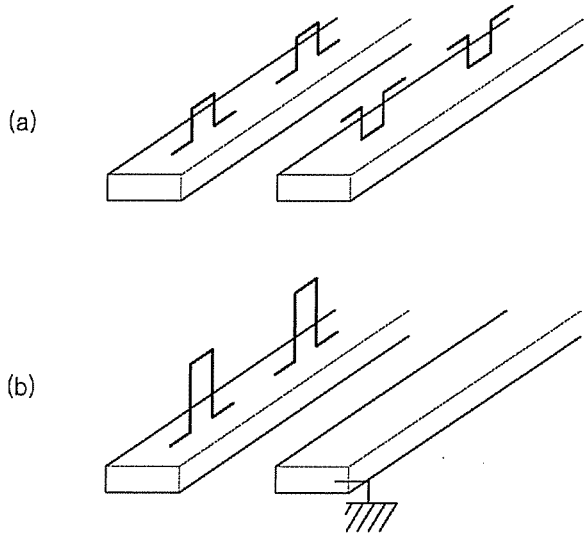
FIG. 13(*a*) and FIG. 13(*b*) are diagrams illustrating a balanced signal and an unbalanced signal.

To understand balun, an understanding of a balanced signal and an unbalanced signal is essential. Examples of the balanced signal and the unbalanced signal are illustrated in FIG. 13. Referring to (a) of FIG. 13, the balanced signal is a method of inputting signals, which have the same size and a phase difference of 180 degrees, to two transmission lines and transmitting the difference between the two signals. The transmission line combines the two wires to transmit a signal. The balanced signal requires one more signal line than the unbalanced signal. However, it is a signal transmission technique having various advantages such as common-mode noise rejection, guaranteed return current path, and signal skew reduction.

Referring to (b) of FIG. 13, the unbalanced signal is a method of using one of the two wires of the transmission line as a ground GND and using the other one as a signal line. The balanced signal that uses both of the two metal wires as signal lines exhibits better characteristics at high frequencies. However, the balanced signal has the disadvantages of difficult matching and measurement and a complicated circuit structure. Thus, it is sometimes more convenient to use the unbalanced signal.

Figure 14:
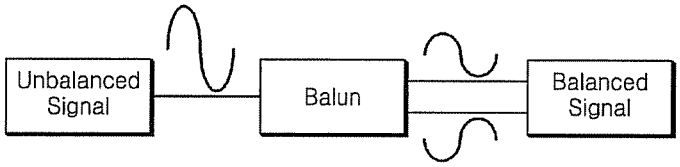
FIG. 14 is a diagram for explaining the concept of a balun.

A radio frequency (RF) circuit includes both a part (such as a mixer or a surface acoustic wave (SAW) filter) using the balanced signal and a part (such as an antenna) using the unbalanced signal. Thus, a matching unit must sometimes be operated like a balun to connect these parts. That is, a balun is not the name of a certain device but refers to all entities used for conversion between the balanced signal and the unbalanced signal, as illustrated in FIG. 14.

Generally, a balun is a three-port passive device that consists of one input port and two output ports. When a signal is transmitted to the input port, signals having the same amplitude and a phase difference of 180 degrees (±90°) are output from the two output ports, respectively. Therefore, electrical characteristics of the balun may be evaluated in terms of insertion loss (how small the loss of signal power between the input and output ports is, phase difference (how close the phase difference between the two signals at the output ports is to 180 degrees), insertion loss difference (how similar the amplitudes of the two signals at the output ports are to each other), and the like.

Figure 15:
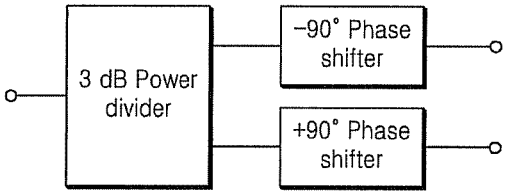
FIG. 15 is a diagram illustrating the structure of a balun.

The conceptual configuration of the balun is illustrated in FIG. 15. Referring to FIG. 15, the balun includes a 3 dB power divider and ±90° phase shifters which are connected to branches of the 3 dB power divider. Therefore, the two signals at the output ports have a phase difference of 180 degrees.

Figure 16:
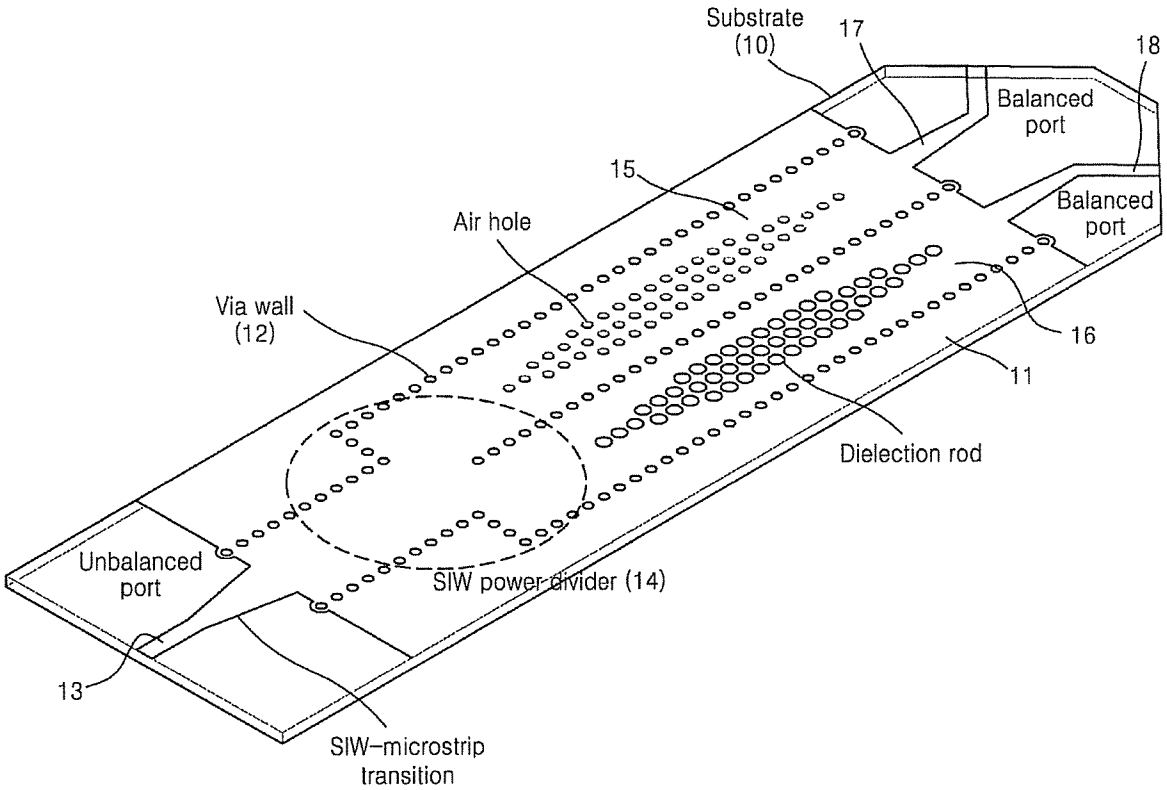
FIG. 16 is a diagram illustrating a balun using an SIW according to another exemplary embodiment of the present invention.
Figure 17:
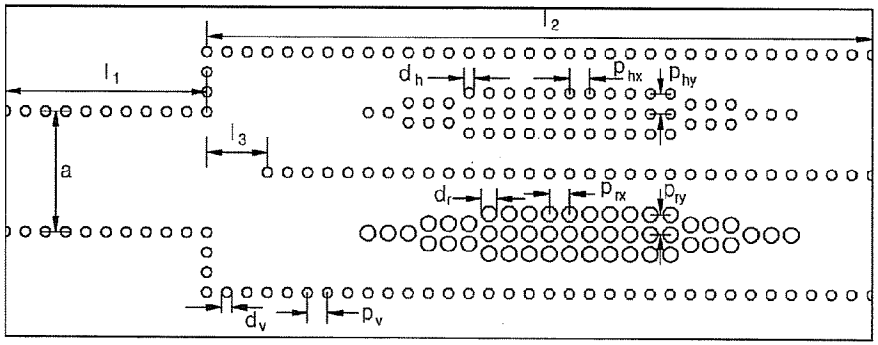
FIG. 17 is a structure diagram for the design of the balun shown in FIG. 16.

FIG. 16 is a diagram illustrating a balun using an SIW according to another exemplary embodiment of the present invention. FIG. 17 is a structure diagram for the design of the balun shown in FIG. 16.

Referring to FIGS. 16 and 17, the balun may include a substrate 10 and a waveguide 11 integrated on the substrate 10. The waveguide 11 may include two columns 12 of via walls which are separated by a width of the waveguide 11 and are arranged parallel to each other, an input port 13, a power divider 14 which divides power of a signal input to the input port 13, first and second branches 15 and 16 of the power divider 14, and first and second output ports 17 and 18 which are respectively connected to the first and second branches 15 and 16. One of the first and second branches 15 and 16 includes a plurality of rods, each including an air hole and a dielectric material inserted into the air hole, and the other one of the first and second branches 15 and 16 includes a plurality of air holes or no air holes. In FIG. 16, the first branch 15 includes a plurality of air holes into which no dielectric material is inserted, and the second branch 16 includes a plurality of rods. However, this is merely an embodiment, and the opposite is possible.

The amount by which the phase of a signal, which passes through the rods and is divided by the power divider 14, is shifted may vary according to at least one of a diameter $d_h$ or $d_r$ of the air holes or the rods, a gap $p_{hx,y}$ or $p_{rx,y}$ between the air holes or the rods, and the number of the air holes or the rods. The amount by which the phase of the signal is shifted may increase in proportion to an increase in the diameter $d_h$ of the air holes. In addition, the amount by which the phase of the signal is shifted may increase as the number of the rods increases. Each of the rods may have a structure in which a dielectric material is inserted into a corresponding air hole by using a male-female screwing method. Here, the amount by which the phase of the signal is shifted may increase as the dielectric material is inserted deeper into the corresponding air hole. The dielectric constant of the substrate 10 may be different from that of the dielectric material inserted into each air hole. Each of the input port 13, the first output port 17, and the second output port 18 has a transition structure to a microstrip line for measurement, and the transition structure may be tapered.

The balun illustrated in FIG. 16 includes ±90-degree phase shifters in the two branches 15 and 16 of the 3 dB power divider 14 of the waveguide 11 (i.e. the SIW) integrated on the substrate 10, respectively. That is, the balun is designed such that two signals at the first and second output ports 17 and 18 have a phase difference of 180 degrees. One of the two phase shifters includes air holes formed in the substrate 10 and thus provides a phase shift of −90 degrees resulting from the fast-wave effect which is induced by the air holes. The other one has a dielectric material inserted into each air hole formed in the substrate 10 and thus provides a phase shift of +90 degrees resulting from the slow-wave effect which is induced by the insertion of the dielectric material into each air hole. A required amount of phase shift may be achieved by adjusting the size of the air holes (dielectric rods), the gap between the air holes, and the number of the air holes. As shown in the drawing, the balun was designed such that the number of air holes gradually increases in order to reduce impedance mismatching caused by a change in dielectric constant. The substrate 10 used for the balun was Taconic's RF-60 ($\in_T$=6.15) with a thickness of 0.635 mm, and a high-k material inserted into each air hole was CER-10 ($\in_T$=10.2). In addition, design variables were a=6 mm, $I_1$=10 mm, $I_2$=30.5 mm, $I_3$=3.5 mm, =0.5 mm, $d_h$=0.55 mm, $d_r$=0.8 mm, $p_v$=1 mm, $p_{hx}$=$p_{rx}$=$P_{ry}$=1.1 mm, and $p_{hy}$=0.9 mm. A microstrip transition structure was used as a feed line for measurement.

Figure 18:
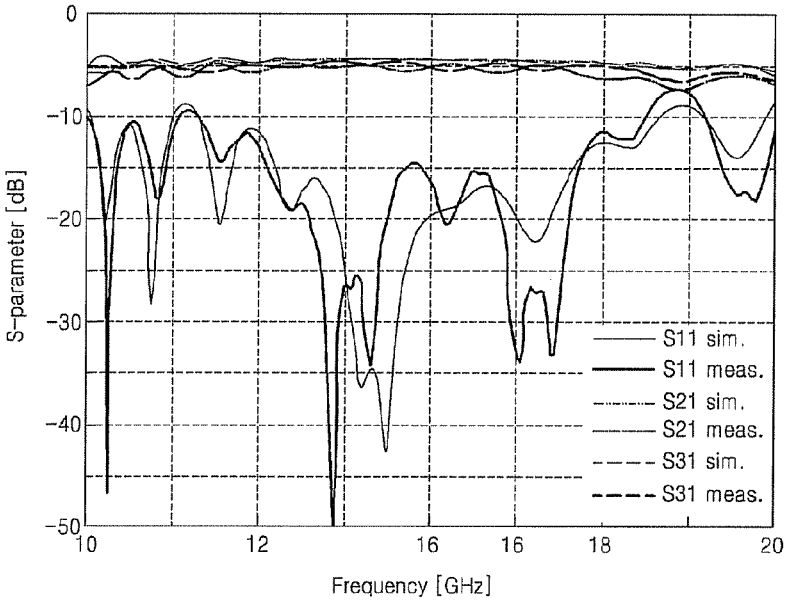
FIG. 18 is a graph illustrating insertion loss and reflection loss.
Figure 19:
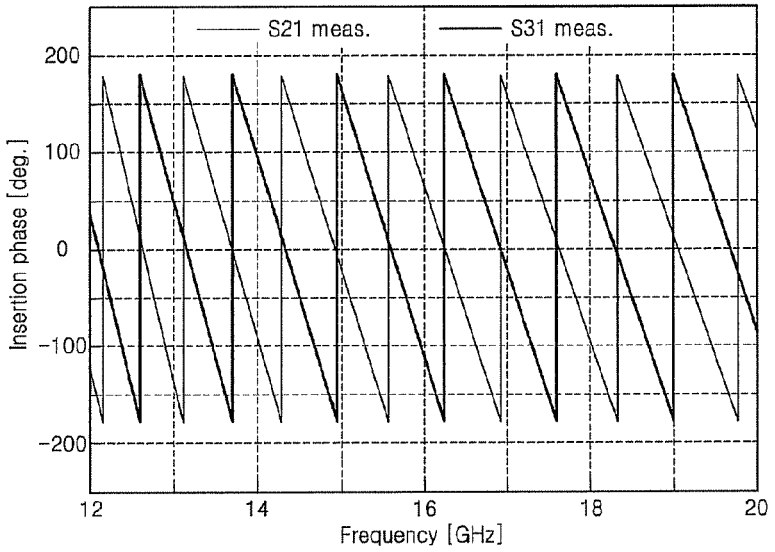
FIG. 19 is a graph illustrating insertion phase.
Figure 20:
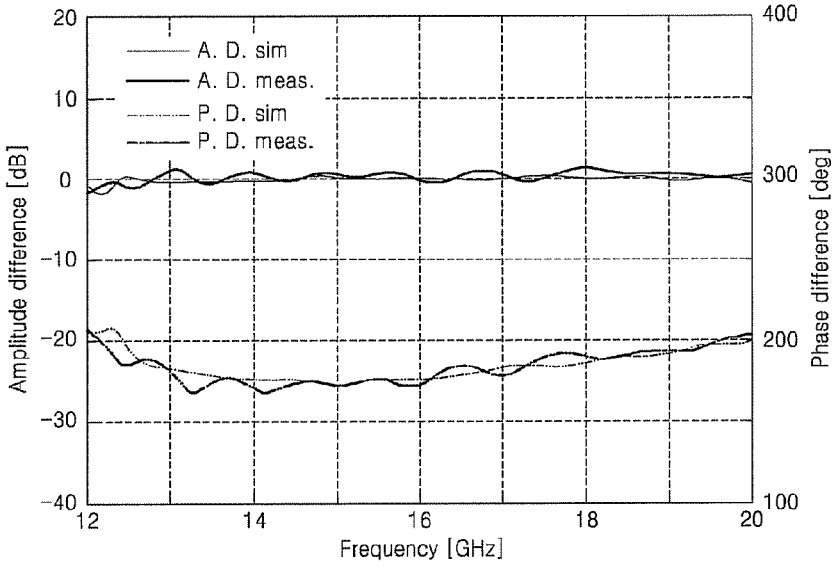
FIG. 20 is a graph illustrating an insertion loss difference and a phase difference.

Measurement results of the balun designed using an HFSS will now be described. FIG. 18 is a graph illustrating insertion loss and reflection loss. FIG. 19 is a graph illustrating insertion phase, and FIG. 20 is a graph illustrating an insertion loss difference and a phase difference. Referring to FIGS. 18 through 20, when a band having a reflection loss of −15 dB or less at an input port is defined as an available frequency band, the balun has a bandwidth of approximately 3.6 GHz (14.1 to 17.7 GHz, Ku-band) and a fractional bandwidth of approximately 22.6% in view of a center frequency of 15.9 GHz. In addition, a maximum insertion loss difference within an available frequency range is less than 1 dB, and a maximum phase difference is less than ±12°.

Figure 21:
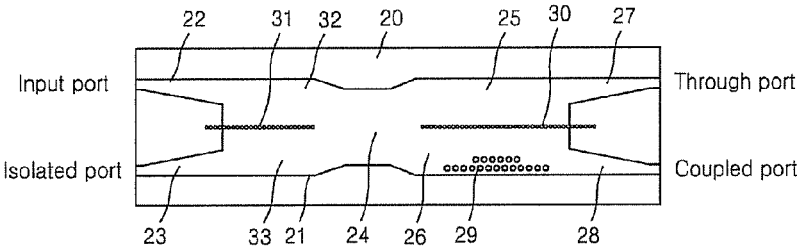
FIG. 21 is a diagram illustrating a directional coupler according to another exemplary embodiment of the present invention.

FIG. 21 is a diagram illustrating a directional coupler using an SIW according to another exemplary embodiment of the present invention.

Referring to FIG. 21, the directional coupler using the SIW may include a substrate 20 and a waveguide 21 integrated on the substrate 20. The waveguide 21 may include a first input branch 32, a second input branch 33, a first output branch 25, a second output branch 26, a first column 31 of via walls which is located between the first input branch 32 and the second input branch 33, a second column 30 of via walls which is located between the first output branch 25 and the second output branch 26, an input port 22 which is connected to one of the first and second input branches 32 and 33, an isolated port 23 which is connected to the other one of the first and second input branches 32 and 33, a power divider 24 which divides the power of a signal received from the input port 22 between the first and second output branches 25 and 26, and first and second output ports 27 and 28 which are respectively connected to the first and second output branches 25 and 26. Any one of the first and second output branches 25 and 26 may have a plurality of rods 29, each including an air hole and a dielectric material inserted into the air hole. The other one of the first and second output branches 25 and 26 may have no air holes. The magnitude of the phase of a signal, which is divided by the power divider 24 and passes through the rods 29, may vary according to at least one of a diameter of the rods 29, a distance between the rods 29, and the number of the rods 29.

Each of the rods 29 may have a structure in which a dielectric material is inserted into a corresponding air hole by using a male-female screwing method. The magnitude of the phase of a signal that passes through the rods 29 structured in this way may increase in proportion to an increase in a depth into which the dielectric material is inserted into each of the rods 29. Further, the dielectric constant of the substrate 20 is different from that of the rods 29.

Each of the input port 22, the first output port 27, and the second output port 28 has a transition structure to a microstrip line for measurement, and the transition structure may be tapered.

Figure 22:
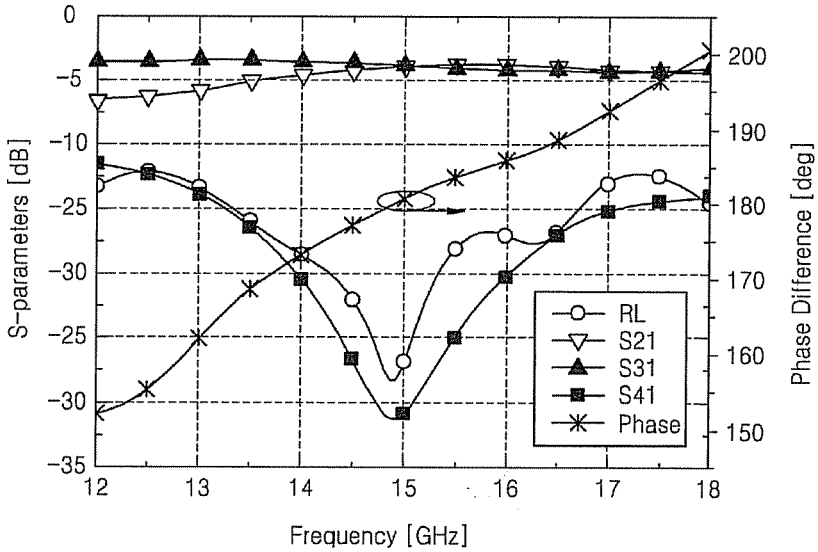
FIG. 22 is a graph illustrating simulation results of the directional coupler.

To identify characteristics of this directional coupler, a real model of the directional coupler was made. For, this model directional coupler, a Duroid 5880 substrate with a thickness of 0.508 mm and a relative dielectric constant of 2.2 was used. After air holes are formed in the substrate, a dielectric material with a high dielectric constant of 10.2 was inserted into each of the air holes, thereby increasing the effective dielectric constant of the substrate to reduce phase velocity. In addition, different numbers of air holes were used for impedance matching. The simulation results of the directional coupler structured as described above are illustrated in FIG. 22. Referring to the simulation results shown in FIG. 22, the directional coupler has a reflection loss $S_{11}$ of 15 dB or less in a frequency range of 13.35 to 16.71 GHz and an isolation degree $S_{41}$ of more than 20 dB in a frequency range of 13.95 to 16.02 GHz. In addition, the directional coupler has an insertion loss $S_{21}$ or $S_{31}$ of 3.9 dB±0.5 dB in a frequency range of 14.67 to 16.62 GHz, and a phase difference between two ports is 180±10 in a frequency range of 13.63 to 16.7 GHz. Therefore, after air holes are formed in a substrate, if a dielectric material having a high relative dielectric constant is inserted into each of the air holes, a phase difference of 180 degrees can be obtained, and superior phase characteristics can be attained in a wide band.

Although a few embodiments of the present invention have been shown and described, it would be appreciated by those skilled in the art that changes may be made in this embodiment without departing from the principles and spirit of the invention, the scope of which is defined in the claims and their equivalents.

The invention claimed is:

1. A phase shifter using a substrate integrated waveguide (SIW), the phase shifter comprising:

a substrate; and a waveguide integrated on the substrate, wherein the waveguide comprises an input port, an output port, two columns of via walls which are separated by a width of the waveguide and are arranged parallel to each other, and a plurality of air holes which are formed to shift a phase of a signal between the input port and the output port, wherein an amount by which the phase of the signal is shifted between the input port and the output port varies according to at least one of a diameter of the plurality of air holes, a distance between adjacent air holes of the plurality of air holes, and the number of the plurality of air holes, wherein the plurality of air holes does not include surfaces with metal material.

2. A phase shifter using a substrate integrated waveguide (SIW), the phase shifter comprising:

a substrate; and a waveguide integrated on the substrate, wherein the waveguide comprises an input port, an output port, two columns of via walls which are separated by a width of the waveguide and are arranged parallel to each other, and a plurality of rods each comprising a dielectric material, which are formed to shift a phase of a signal between the input port and the output port.

3. The phase shifter of claim 1, wherein the amount by which the phase of the signal is shifted between the input port and the output port varies according to at least one of a diameter of the plurality of rods, a distance between adjacent rods, and the number of the plurality of rods.

4. The phase shifter of claim 1, wherein each of the plurality of rods has a structure in which the respective dielectric material is inserted into a corresponding air hole formed in the waveguide by using a male-female screwing method.

5. The phase shifter of claim 1, wherein each of the rods has a structure in which the respective dielectric material is inserted into a corresponding air hole formed in the waveguide and the amount by which the phase of the signal is shifted increases in proportion to an increase in a depth to which the dielectric material is inserted into the air hole.

6. A balun using an SIW, the balun comprising:

a substrate; and a waveguide integrated on the substrate, wherein the waveguide comprises two columns of via walls which are separated by a width of the waveguide and are arranged parallel to each other, an input port, a power divider which divides power of a signal input to the input port, first and second branches of the power divider, and a first output port and a second output port which are connected respectively to the first branch and the second branch, wherein any one of the first and second branches has a plurality of rods, each of the plurality of rods comprising a respective air hole and a corresponding dielectric material inserted into the respective air hole, and the other one of the first and second branches has a plurality of air holes or no air holes.

7. The balun of claim 6, wherein a magnitude of a phase of a signal which passes through the air holes varies according to at least one of a diameter of the air holes, a distance between adjacent air holes, and the number of the air holes.

8. The balun of claim 6, wherein a magnitude of a phase of a signal which passes through the plurality of rods varies according to at least one of a diameter of the plurality of rods, a distance between adjacent rods the plurality of rods, and the number of the plurality of rods.

9. The balun of claim 8, wherein each of the plurality of rods has a respective structure in which the corresponding dielectric material is inserted into the respective air hole by using a male-female screwing method, and a magnitude of the phase of the signal which passes through the plurality of rods increases in proportion to an increase in a depth to which the dielectric material is inserted into the air hole in each of the plurality of rods.

10. A directional coupler using an SIW, the directional coupler comprising:

a substrate; and a waveguide integrated on the substrate, wherein the waveguide comprises a first input branch, a second input branch, a first output branch, a second output branch, a first column of via walls which is located between the first input branch and the second input branch, a second column of via walls which is located between the first output branch and the second output branch, an input port which is connected to one of the first input branch and the second input branch, and an isolated port which is connected to the other one of the first input branch and the second input branch, a power divider which divides power of a signal input to the input port between the first output branch and the second output branch, and a first output port and a second output port which are connected respectively to the first output branch and the second output branch, wherein any one of the first and second output branches has a plurality of rods, each comprising an air hole and a dielectric material inserted into the air hole, and the other one of the first and second branches has no air holes.

11. The directional coupler of claim 10, wherein the magnitude of a phase of a signal which passes through the plurality of rods varies according to at least one of a diameter of the plurality of rods, a distance between adjacent rods the plurality of rods, and the number of the plurality of rods.

12. The directional coupler of claim 10, wherein each of the plurality of rods has a structure in which the respective dielectric material is inserted into the respective air hole by using a male-female screwing method, and a magnitude of the phase of the signal which passes through the plurality of rods increases in proportion to an increase in a depth to which the dielectric material is inserted into the air hole in each of the plurality of rods.

13. An SIW comprising:

a substrate; and a waveguide integrated on the substrate, wherein the waveguide comprises two columns of via walls which are separated by a width of the waveguide and are arranged parallel to each other and a plurality of rods, each comprising a respective air hole and a corresponding dielectric material inserted into the respective air hole by using a male-female screwing method to variably shift a phase of a signal.

* * * * *